US010950920B2

(12) United States Patent
Ligander et al.

(10) Patent No.: US 10,950,920 B2
(45) Date of Patent: Mar. 16, 2021

(54) TRANSITION BETWEEN A TUBULAR WAVEGUIDE BODY AND AN EXTERNAL PLANAR CONNECTION PORTION THROUGH A PLANAR MATCHING RIDGE IN THE WAVEGUIDE BODY

(71) Applicant: Telefonaktiebolaget LM Ericsson (publ), Stockholm (SE)

(72) Inventors: Per Ligander, Gothenburg (SE); Thomas Emanuelsson, Västra Frölunda (SE); Ola Tageman, Gothenburg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 4 days.

(21) Appl. No.: 16/321,133

(22) PCT Filed: Aug. 8, 2016

(86) PCT No.: PCT/EP2016/068875
§ 371 (c)(1),
(2) Date: Jan. 28, 2019

(87) PCT Pub. No.: WO2018/028762
PCT Pub. Date: Feb. 15, 2018

(65) Prior Publication Data

US 2019/0165443 A1 May 30, 2019

(51) Int. Cl.
*H01P 5/107* (2006.01)
*H01P 3/12* (2006.01)
*H01P 5/02* (2006.01)

(52) U.S. Cl.
CPC ..... *H01P 5/107* (2013.01); *H01P 3/121* (2013.01); *H01P 5/024* (2013.01)

(58) Field of Classification Search
CPC ..... H01P 5/107
(Continued)

(56) References Cited

U.S. PATENT DOCUMENTS 2,633,493 A * 3/1953 Cohn ..... H01P 5/103 333/34
2,825,876 A 3/1958 Le Vine et al.
(Continued)

FOREIGN PATENT DOCUMENTS

EP 0074613 A1 3/1983
EP 1772904 A2 4/2007

*Primary Examiner* — Benny T Lee
(74) *Attorney, Agent, or Firm* — Coats + Bennett, PLLC

(57) ABSTRACT

It is provided a waveguide comprising a tubular, electrically conductive waveguide body, the waveguide having a rectangular cross-section. The waveguide further comprises an electrically conductive foil comprising at least one matching portion arranged within the waveguide body, extending along a propagation direction of the waveguide body, and at least one connection portion arranged outside of the waveguide body, for connecting the waveguide to a component, wherein the matching portion of the foil is tapered in a propagation direction of the waveguide and arranged to form a ridge protruding from a sidewall of the waveguide along part of the length of the waveguide, and wherein the connection portion extends outside of the waveguide, in a propagation direction of the waveguide and in the same plane as the matching portion. It is also provided a waveguide arrangement and a method for manufacturing such a waveguide arrangement.

18 Claims, 6 Drawing Sheets

(58) Field of Classification Search
USPC ..... 333/26
See application file for complete search history.

(56) References Cited

U.S. PATENT DOCUMENTS

| | | | | | |
|---|---|---|---|---|---|
| 2,981,904 | A * | 4/1961 | Ajioka et al. | H01P 5/103 | 333/34 |
| 3,969,691 | A * | 7/1976 | Saul | H01P 1/16 | 333/21 R |
| 5,262,739 | A * | 11/1993 | Dalman | H01P 5/10 | 333/26 |
| 5,600,740 | A | 2/1997 | Asfar | | |
| 6,639,486 | B2 * | 10/2003 | Buck | H01P 5/107 | 333/26 |
| 2016/0072174 | A1 | 3/2016 | Takeda et al. | | |

* cited by examiner

TRANSITION BETWEEN A TUBULAR WAVEGUIDE BODY AND AN EXTERNAL PLANAR CONNECTION PORTION THROUGH A PLANAR MATCHING RIDGE IN THE WAVEGUIDE BODY

TECHNICAL FIELD

The present disclosure relates to a waveguide and to a waveguide arrangement comprising a component and a waveguide transition.

BACKGROUND

With the increasing requirements for communication systems, microwave communication systems are developed to operate at higher and higher frequencies. With increasing frequencies, there are parts of the microwave communication system which must be redesigned or changed.

For example, the most common type of waveguide feed is based on transitions from single ended line (microstrip) to some type of probe inside the waveguide. Feeding a waveguide with a balanced transition is not so common; it is normally based on a balanced probe inside the waveguide feeding the waveguide perpendicular to the waveguide propagation direction, and the probe have to be covered with a short-back.

A higher operating frequency leads to a reduced size of the rectangular waveguide, and there is thus no room for e.g. PCB based probes or other standard types of mechanical arrangements. Even if would in some cases be possible to adapt a PCB-based probe for use in a high frequency waveguide, such an arrangement would place high demands on the assembly process.

Accordingly, there is a need for an improved waveguide transition arrangement capable of operating at high frequencies, such as the D-band frequency range.

SUMMARY OF THE INVENTION

In view of above-mentioned and other drawbacks of the prior art, it is an object of the present invention to provide an improved waveguide comprising means for forming a waveguide transition.

According to a first aspect, a waveguide comprises a tubular, electrically conductive waveguide body, the waveguide having a rectangular cross-section. The waveguide further comprises an electrically conductive foil comprising at least one matching portion arranged within the waveguide body, extending along a propagation direction of the waveguide body, and at least one connection portion arranged outside of the waveguide body, for connecting the waveguide to a component, wherein the matching portion of the foil is tapered in a propagation direction of the waveguide and arranged to form a ridge protruding from a sidewall of the waveguide along part of the length of the waveguide, and wherein the connection portion extends outside of the waveguide, in a propagation direction of the waveguide and in the same plane as the matching portion.

Hereby, a waveguide is provided where a connecting portion of the foil arranged in the same plane as the matching portion of the foil enables the connection of a chip to the waveguide outside of the waveguide itself. Moreover, the described waveguide provided a compact solution with a short transmission path and low losses.

According to some aspects, the tapering of the foil is a staircase shaped tapering, a curved tapering or a straight tapering.

According to some aspects, the foil comprises two symmetrically aligned matching portions and two corresponding symmetrically aligned connection portions, the matching portions being arranged to protrude opposite each other from opposing sidewalls of the waveguide body such that the foil forms a balanced waveguide transition. Accordingly, two ridges are positioned against each other in order to create a balanced ridge transition represented by the foil.

Hereby a direct transition from a chip with balanced output or from a differential line on a PCB to a balanced waveguide transition is enabled by means of the described configuration of the foil. Accordingly there is no need for a balun, which simplifies the construction of the waveguide transmission and reduces transition losses.

According to some aspects, there is provided a waveguide arrangement comprising a waveguide as described above and further comprising a component configured to generate a signal to be provided to the waveguide, wherein the a least one connection portion of the foil is connected to the component.

Hereby, a component such as a power amplifier or low noise amplifier can be directly connected to the waveguide via the connection portion of the foil with a short transmission path and low losses.

Moreover, according to some aspects, the component is arranged on a substrate, selected from the group comprising a PCB, a silicon substrate, and a ceramic substrate.

Thereby, the waveguide can be connected to a component which is mounted to a substrate, either by connecting directly to the component or by connecting via the substrate.

According to some aspects, the at least one connection portion of the foil is electrically connected to the component by means of soldering, wire bonding, thermocompression bonding or gluing.

Hereby, conventional connection techniques can be used to connect the waveguide to a component, making it easy to integrate the waveguide in existing production flow.

The object stated above is further obtained by a method for manufacturing a waveguide arrangement, comprising providing a waveguide. The waveguide comprises a tubular, electrically conductive waveguide body, the waveguide having a rectangular cross-section. The waveguide further comprises an electrically conductive foil comprising at least one matching portion arranged within the waveguide body, extending along a propagation direction of the waveguide body, and at least one connection portion arranged outside of the waveguide body, for connecting the waveguide to a component, wherein the matching portion of the foil is tapered in a propagation direction of the waveguide and arranged to form a ridge protruding from a sidewall of the waveguide along part of the length of the waveguide, and wherein the connection portion extends outside of the waveguide, in a propagation direction of the waveguide and in the same plane as the matching portion. The method further comprises providing a microwave component comprising at least one connection line for connecting to a waveguide and forming an electrical connection between the least one connection port of the component and the at least one connection portion of the foil.

Hereby, a method is provided which enables the use of a waveguide comprising a component-to-waveguide transition as described above.

Further aspects and advantages discussed above in relation to the waveguide and waveguide arrangement are equally applicable for the method for manufacturing a waveguide arrangement.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features and advantages of the present invention will become apparent when evaluating the appended claims and the following description. The skilled person realize that different features of the present invention may be combined to create embodiments other than those described in the following, without departing from the scope of the present invention.

BRIEF DESCRIPTION OF THE DRAWINGS

The present technique is now described, by way of example, with reference to the accompanying drawings, in which.

DETAILED DESCRIPTION OF THE INVENTION

The present technique will now be described more fully hereinafter with reference to the accompanying drawings, in which certain aspects of the invention are shown. This invention may, however, be embodied in many different forms and should not be construed as limited to the embodiments and aspects set forth herein; rather, these embodiments are provided by way of example so that this disclosure will be thorough and complete, and will fully convey the scope of the invention to those skilled in the art. Like numbers refer to like elements throughout the description.

In the following detailed description, various aspects of the waveguide and waveguide arrangement according to the present technique are mainly described with reference to a differential waveguide arrangement for connecting to a component with a differential output. However, a waveguide for connecting to a single ended output is also described, and the advantages described in relation to a waveguide for a differential connection are equally applicable to a waveguide with a single-ended connection. Moreover, the described waveguide and waveguide arrangement is suitable for use in a communications system.

Figure 1A:
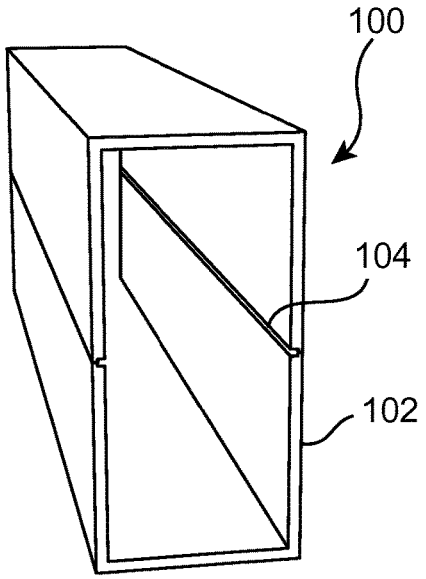
FIGS. 1A-1E schematically illustrate a waveguide according to embodiments of the present technique.
Figure 1B:
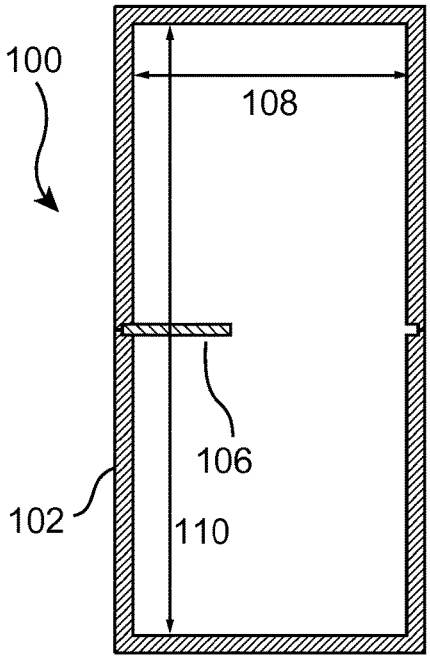
Figure 1C:
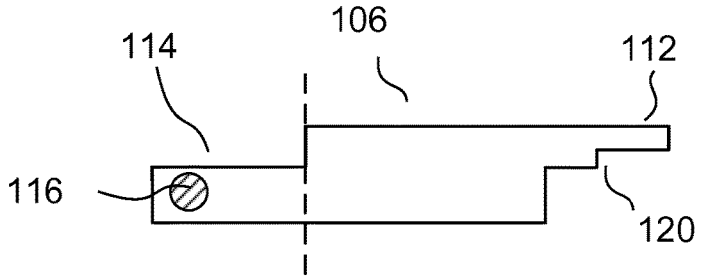

FIGS. 1A-1C schematically illustrate a waveguide 100 (FIGS. 1A and 1B) comprising a tubular, electrically conductive waveguide body 102 (FIGS. 1A and 1B), the waveguide 100 having a rectangular cross-section. The waveguide 100 further comprises an electrically conductive foil 106 (FIGS. 1B and 10) comprising at least one matching portion 112 (FIG. 10) arranged within the waveguide body 102, extending along a propagation direction of the waveguide body 102, and at least one connection portion 114 (FIG. 1C) arranged outside of the waveguide body 102, for connecting the waveguide 100 to a component. The matching portion 112 of the foil 106 is tapered in a propagation direction of the waveguide and arranged to form a ridge protruding from a sidewall 104 (FIG. 1A) of the waveguide 100 along part of the length of the waveguide 100. The connection portion 114 extends outside of the waveguide 100, in a propagation direction of the waveguide 100 and in the same plane as the matching portion 106. The propagation direction of the waveguide 100 is here the length direction of the waveguide 100 as seen from the waveguide transition. Accordingly, the foil 106 is tapered so that its extension from the sidewall of the waveguide body 102 is reduced with increasing distance from the waveguide opening, as seen from the part of the waveguide in which the foil and the waveguide transition is located and where the connection portion 114 of the foil 106 extends outside of the waveguide.

Figure 1D:
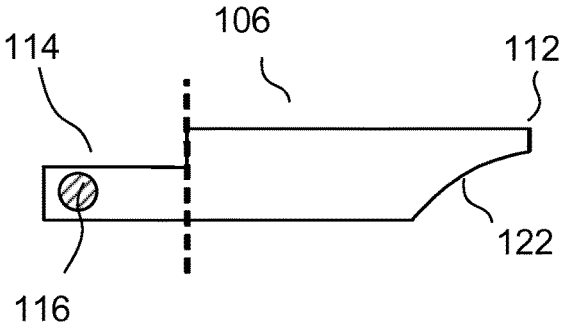
Figure 1E:
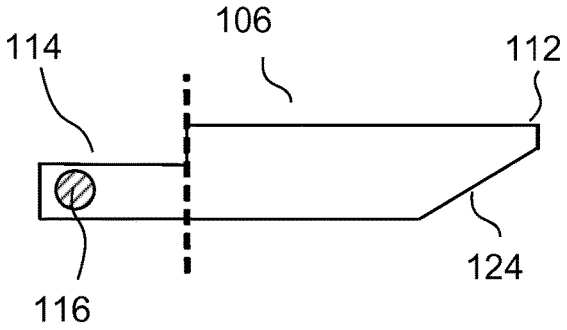

FIGS. 1C-1E schematically illustrate different types of tapering of the foil, where FIG. 1C illustrates a matching portion 112 comprising a staircase shaped tapering 120, FIG. 1D illustrates a matching portion 112 comprising a curved tapering 122, and FIG. 1E illustrates a matching portion 112 comprising a straight tapering 124. Accordingly, different types of tapering are possible to achieve the desired effect.

As illustrated in FIG. 1A and FIG. 1B, the waveguide 100 may be divided into two equal portions such that the foil 106 (FIG. 1B) is located between the two portions. The waveguide may also comprise a trench, groove or the like in which the foil 106 may be arranged. The rectangular waveguide has a width 108 and a height 110 as shown in FIG. 1B determining the frequency band of the waveguide. As will be described in the following, the waveguide may also be part of a larger mechanical arrangement used to cover and protect a component connected to the waveguide.

The described waveguide is particularly suitable for D-band frequencies and above, since the size of the waveguide is inversely proportional to the frequency of the signal. As an example, the D-band waveguide has a width 108 of about 0.83 mm and a height 110 of about 1.6 mm. A waveguide in that size range is difficult to feed using previously known techniques where a probe needs to be arranged within the waveguide. The overall length of the foil 106 illustrated in FIG. 10 is about 1.5 mm where the length of the connection portion 114 is about 0.5 mm and the length of the matching portion 112 is about 1 mm. Moreover, the foil has a thickness in the range of 100 to 500 μm, and is made from an electrically conductive material.

As further highlighted by FIG. 1C, a connection point 116 is illustrated on the connection portion 114 of the foil 106 to clearly illustrate that the connection to the foil 106 is made in the plane of the foil 106, thereby enabling a transition having a small size.

Figure 2A:
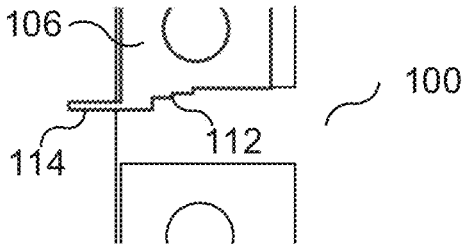
FIGS. 2A and 2B schematically illustrate a waveguide according to embodiments of the present technique.

FIG. 2A schematically illustrates a cross section of a waveguide 100 comprising a foil 106 as seen from above, where the cut is made at half the height 110 (FIG. 1B) of the waveguide body 102 (FIG. 1B). As can be seen in FIG. 2A, the foil as such may be larger than just the active portions, i.e. the connection portion 114 and the matching portion 112 in order to form a foil which is easier to handle and better suited for arranging in a waveguide as will be further illustrated in the following. The portions of the foil 106 not comprising the active portions 112, 114 can be seen as mechanical support.

Figure 2B:
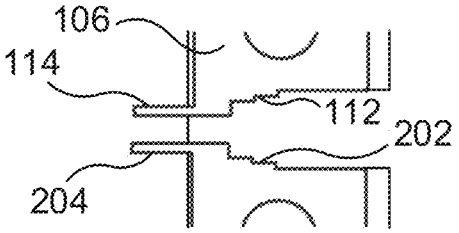

In FIG. 2B, the foil 106 comprises two symmetrically aligned matching portions 112, 202 and two corresponding symmetrically aligned connection portions 114, 204, the matching portions being arranged to protrude opposite each other from opposing sidewalls of the waveguide body 102 such that the foil 106 forms a balanced waveguide transition.

Hereby, a differential, i.e. a balanced waveguide transition is formed, where the two connection portions 114, 204 are configured to be connected to a balanced output of a component. The foil can be made in one piece or as separate pieces, and the foil in the present context refers to the entire foil forming the waveguide transition.

Figure 3A:
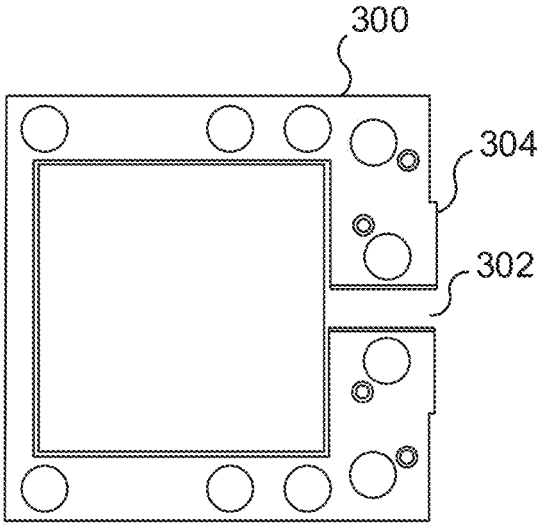
FIGS. 3A and 3B schematically illustrate a box for a waveguide arrangement according to embodiments of the present technique.

FIG. 3A illustrates a box 300, or a frame, which is typically arranged on a circuit board, such as a PCB. The box 300 is made to hold a component to be connected to the waveguide. FIG. 3A is further showing the waveguide, without a foil, as an opening 302 in the wall of the box 300

Figure 3B:
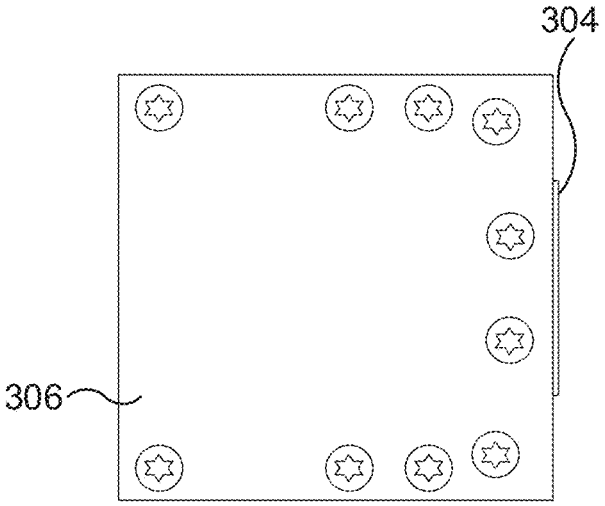

The box 300 along with the lid 306 shown in FIG. 3B forms an enclosed volume when the lid 306 is screwed or otherwise fixed to the box 300. The box can be made from metal or plastic and the size of a box for holding a D-band microwave component can be about 10×10 mm.

Moreover, the waveguide is configured to be connected to a flange for connection to e.g. an antenna. The flange is connected to the protruding portion 304 illustrated in FIGS. 3A and 3B.

A waveguide arrangement comprising a waveguide, further comprising a component (400) configured to generate a signal to be provided to the waveguide, wherein the a least one connection portion of the foil is connected to the component. (FIG. 4A)

Figure 4A:
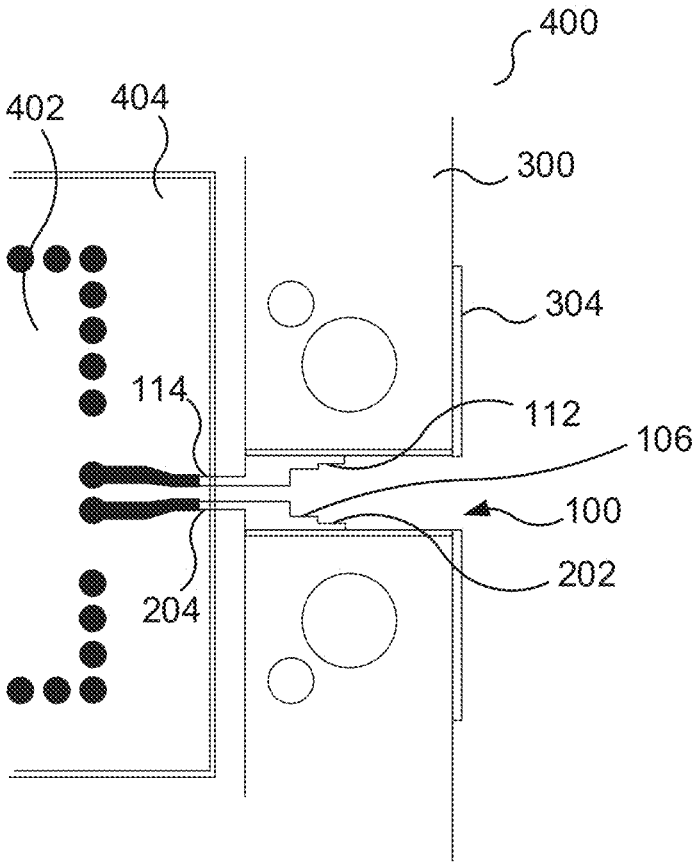
FIGS. 4A and 4B schematically illustrate a waveguide arrangement according to embodiments of the present technique.
Figure 4B:
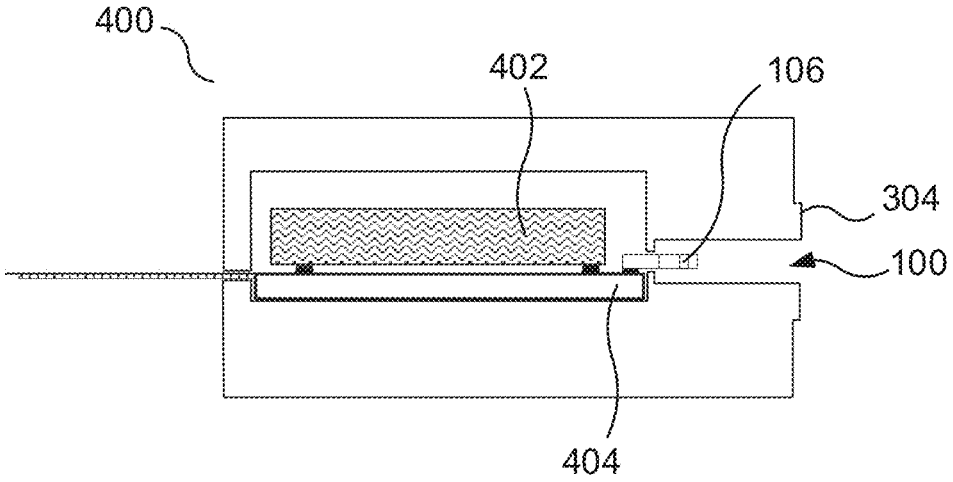

FIGS. 4A and 4B schematically illustrate a waveguide arrangement 400 comprising a waveguide 100 (FIG. 1A) and a component 402 configured to generate a signal to be provided to the waveguide 100, wherein the at least one connection portion of the foil is connected to the component 402. The component can for example be a power amplifier or a low noise amplifier.

The component 402 is arranged on a substrate 404, and the waveguide transition is here illustrated as a balanced transition where the foil 106 comprises two connection portions 114, 204 (FIG. 4A) connected to a component 402 having a balanced output. In particular, the connection portions 114, 204 (FIG. 4A) of the foil 106 are connected to two corresponding balanced differential lines on a substrate 404 in the form of a printed circuit board (PCB) on which the component 402 is arranged. The connection portions 114, 204 are electrically connected to the component 402 by means of soldering. As illustrated in FIGS. 4A and 4B, the connection portions 114, 204 are soldered to the differential lines of the substrate 404 and the component 402 is in turn soldered to the substrate 404 and connected to the waveguide via a balanced connection of the component 402.

The substrate 404 is selected from the group comprising a PCB, a silicon substrate, and a ceramic substrate. Accordingly, the described waveguide transition can be used and integrated with conventional and commonly used substrates.

Figure 5A:
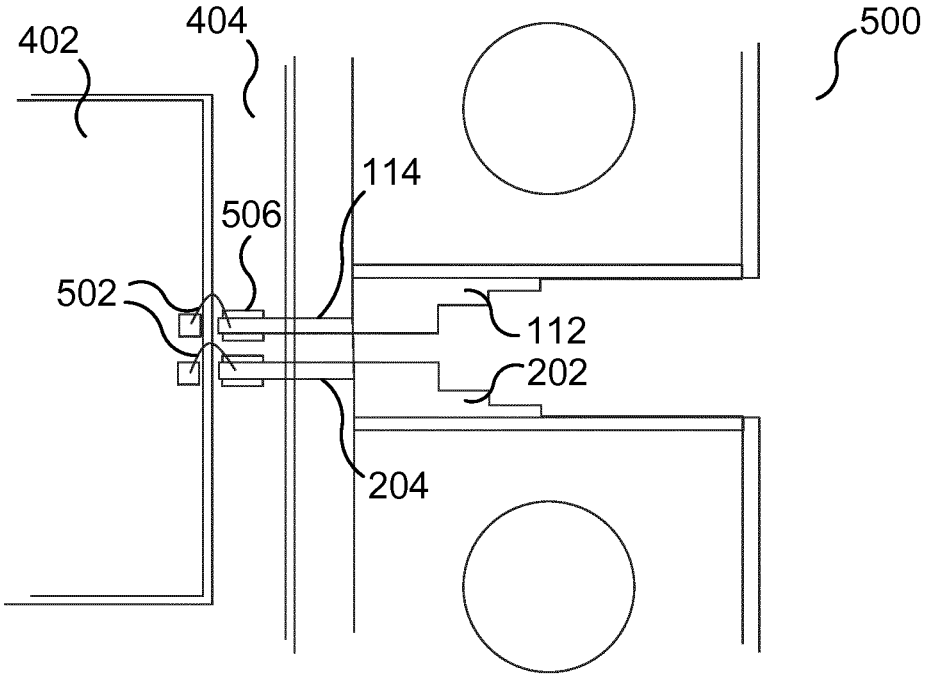
FIGS. 5A and 5B schematically illustrate a waveguide arrangement according to embodiments of the present technique.
Figure 5B:
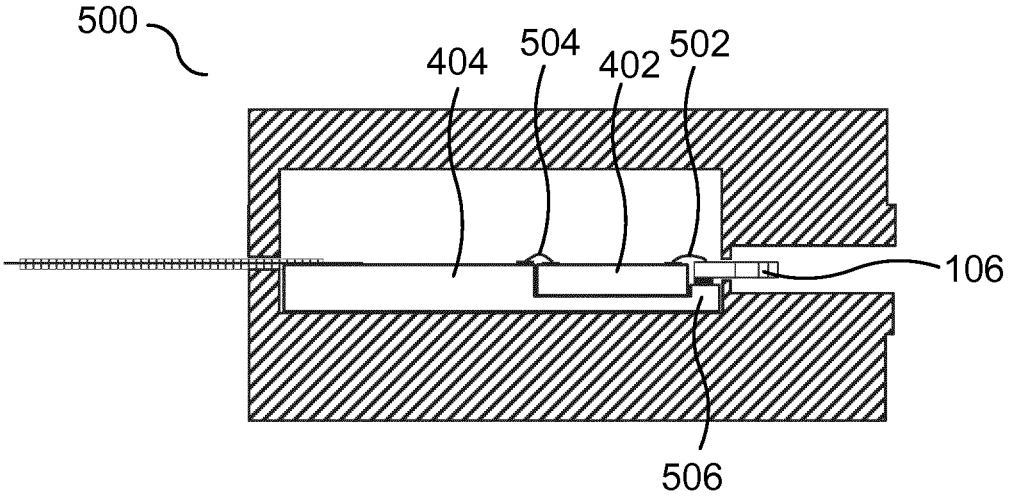

FIGS. 5A-5B schematically illustrate a waveguide arrangement 500 where the at least one connection portion of the foil 106 (FIG. 5B) is electrically connected to the component 402 by means of wire bonding. In the waveguide arrangement 500 in FIGS. 5A and 5B, the component 402 is located in a recessed portion of the substrate 404, and the connection portions 114, 204 (FIG. 5A) of the foil 106 are directly connected to the component 402 by means of wire bonds 502. FIG. 5B is a side view illustrating the direct wire-bonded component 402 to waveguide transition. The component 402 is in turn wire bonded 504 to the substrate 404. As further illustrated by FIG. 5B, the substrate 404 is formed to provide support 506 for the connecting portions 114, 204 of the foil 106.

Figure 6A:
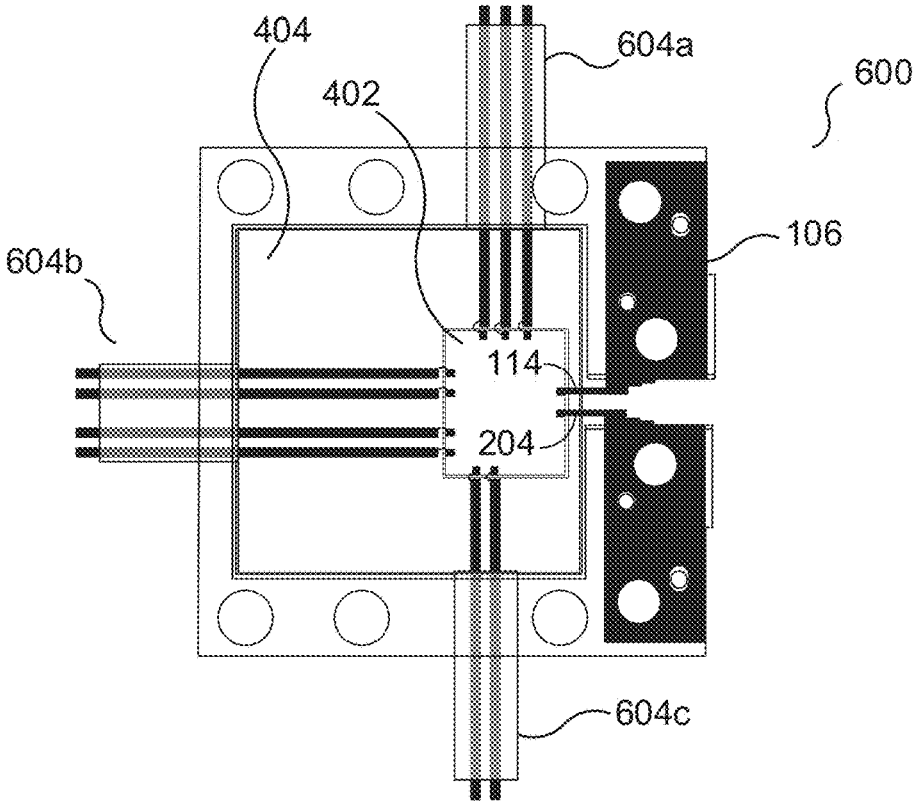
FIGS. 6A and 6B schematically illustrate a waveguide arrangement according to embodiments of the present technique.
Figure 6B:
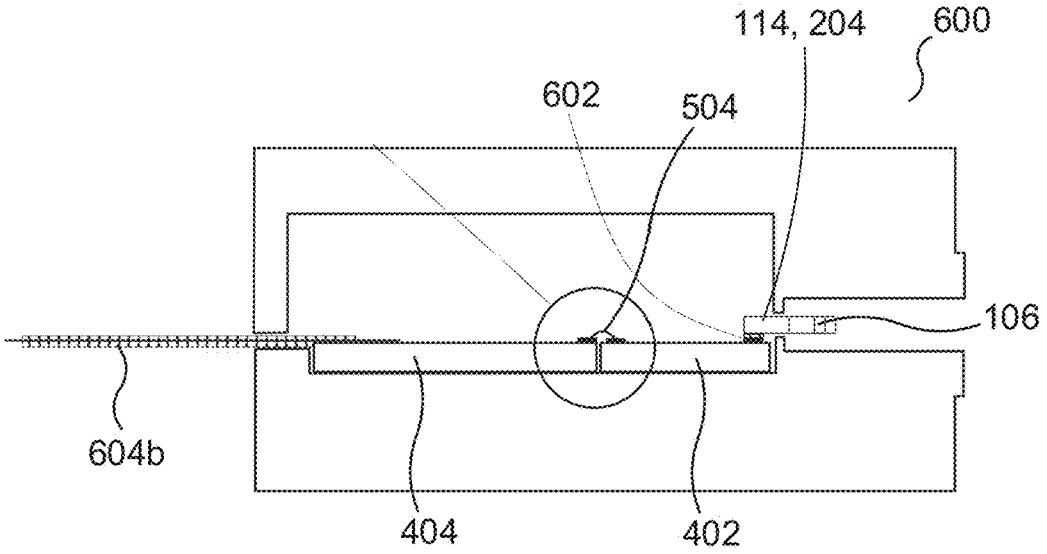

FIGS. 6A-6B schematically illustrate a waveguide arrangement 600 where the at least one connection portion of the foil 106 is electrically connected to the component 402 by means of glue 602 (FIG. 6B). Here, a conductive glue 602 is used to connect the connection portions 114, 204 of the foil 106 to the component 402 and the component 402 is in turn wire bonded 504 (FIG. 6B) to the substrate 404.

FIG. 6A also illustrates connections 604*a* and 604*b* to the component 402 in the form of flex cables. The connections 604*a* and 604*b* can for example be LO (local oscillator), IF (intermediate frequency) and bias connections.

Figure 7:
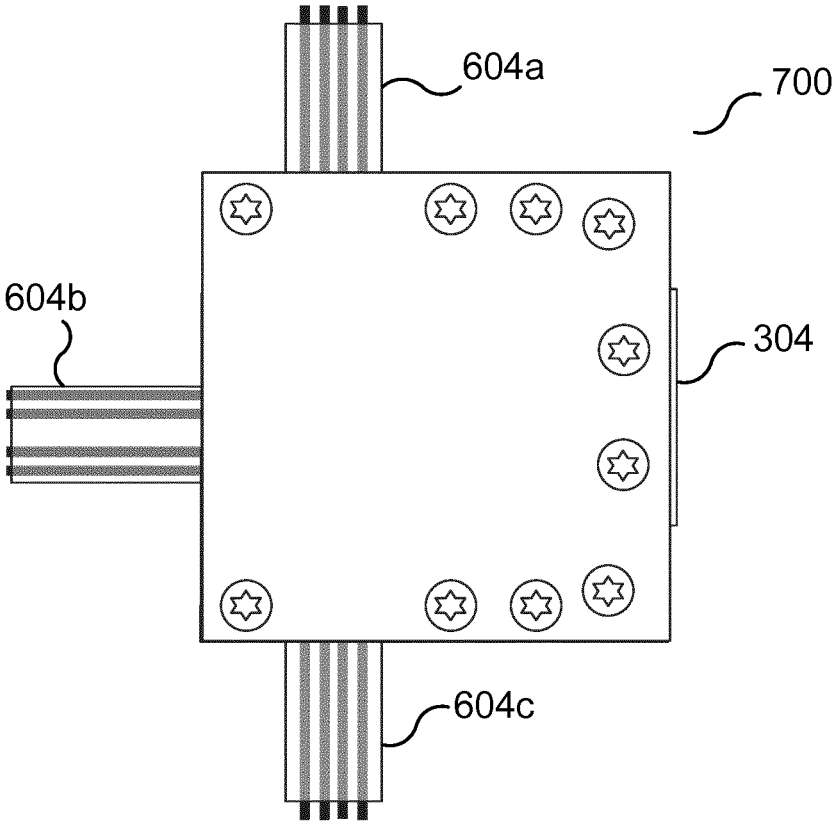
FIG. 7 schematically illustrates a package comprising a waveguide arrangement according to embodiments of the present technique.

FIG. 7 illustrates a complete sealed package 700 comprising a component arranged within the box along with external connections 604*a*-604*c* and a protrusion 304 for connecting the package to a flange.

Figure 8:
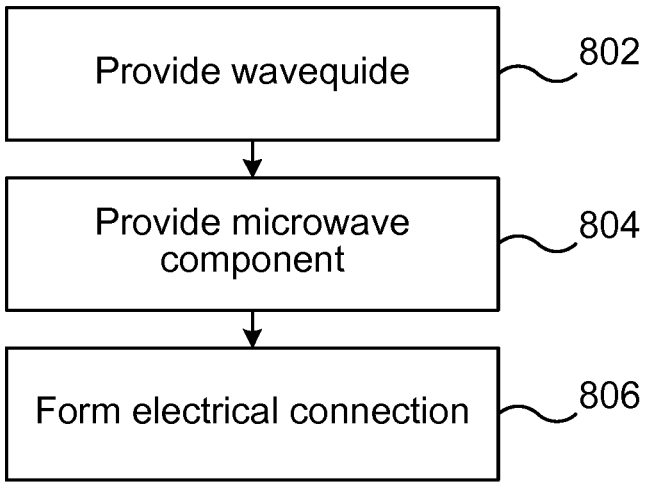
FIG. 8 is a flow chart outlining the general steps of a method for manufacturing a waveguide arrangement according to embodiments of the present technique.

FIG. 8 is a flow chart outlining the general steps of a method according to an embodiment of the present technique. As seen in FIG. 8, and with reference to FIGS. 1A-1E and 2A-2B, the method for manufacturing a waveguide arrangement comprises providing at step 802 a waveguide 100 (FIGS. 1B and 2A) comprising a tubular, electrically conductive waveguide body 102 (FIGS. 1A and 1B), the waveguide having a rectangular cross-section, an electrically conductive foil 106 (FIGS. 1B-1E, 2A and 2B) comprising at least one matching portion 112 (FIGS. 1C-1E and 2B) arranged within the waveguide body 102, extending along a propagation direction of the waveguide body 102, and at least one connection portion 114 arranged outside of the waveguide body 102, for connecting the waveguide to a component. The matching portion 112 of the foil is staircase shaped and arranged to form a ridge protruding from a sidewall of the waveguide along part of the length of the waveguide; and the connection portion 114 extends outside of the waveguide, in a propagation direction of the waveguide and in the same plane as the matching portion. The method further comprises providing at step 804 a microwave component comprising at least one connection port for connecting to a waveguide; and forming at step 806 an electrical connection between the least one connection port of the component and the at least one connection portion of the foil.

The foil can for example be manufactured by stamping, etching or Electrical Discharge Machining, EDM. EDM can provide resolutions down to 3 μm which may be required for the above described type of foil suitable for use for in a D-band waveguide. There is no limitation on the type of chip which can be mounted on the PCB, e.g. naked chip wire-bonded or soldered packages can be used.

Even though the invention has been described with reference to specific exemplifying embodiments thereof, many different alterations, modifications and the like will become apparent to those skilled in the art from an evaluation-of the drawings, the disclosure, and the appended claims. Also, it should be noted that parts of the connector arrangement may be omitted, interchanged or arranged in various ways, the connector arrangement yet being able to perform the functionality of the present invention. The mere fact that certain measures are recited in mutually different dependent claims does not indicate that a combination of these measured cannot be used to advantage. Additionally, variations to the disclosed embodiments can be understood and effected by the skilled person in practicing the claimed invention. In the claims, the word "comprising" does not exclude other elements or steps, and the indefinite article "a" or "an" does not exclude a plurality.

The invention claimed is:

1. A waveguide, comprising:

a tubular, electrically conductive waveguide body;

an electrically conductive foil, the foil comprising:

at least one planar matching portion arranged within the waveguide body and extending along a propagation direction of the waveguide body; and at least one planar connection portion arranged in a same plane as the at least one planar matching portion, the at least one planar connection portion disposed outside of the waveguide body for connecting the waveguide to a component;

wherein the at least one planar matching portion of the foil is tapered in the propagation direction of the waveguide and arranged to form a ridge protruding from a sidewall of the waveguide along part of the length of the waveguide;

wherein the at least one planar connection portion is disposed outside of the waveguide body and extends beyond an end of the waveguide body in the propagation direction of the waveguide;

wherein the waveguide has a rectangular cross-section; and wherein the component is a power amplifier or a low noise amplifier.

2. The waveguide of claim 1, wherein the at least one planar matching portion comprises a curved tapering.

3. The waveguide of claim 1, wherein the at least one planar matching portion comprises a straight tapering.

4. The waveguide of claim 1, wherein the at least one planar matching portion and the at least one planar connection portion of the foil comprises, respectively, two symmetrically aligned planar matching portions and two corresponding symmetrically aligned planar connection portions, the two planar matching portions being arranged to protrude opposite to each other from opposing sidewalls of the waveguide body such that the foil forms a balanced waveguide transition.

5. The waveguide of claim 1, wherein a thickness of the foil is in the range of 100 μm to 500 μm.

6. The waveguide of claim 1, wherein the waveguide is a D-band waveguide.

7. The waveguide of claim 1, wherein the at least one planar matching portion comprises a staircase shaped tapering.

8. A waveguide arrangement, comprising:

a waveguide, wherein the waveguide comprises:

a tubular, electrically conductive waveguide body;

an electrically conductive foil, the foil comprising:

at least one planar matching portion arranged within the waveguide body and extending along a propagation direction of the waveguide body; and at least one planar connection portion arranged in a same plane as the at least one planar matching portion, the at least one planar connection portion disposed outside of the waveguide body for connecting the waveguide to a component;

wherein the at least one planar matching portion of the foil is tapered in the propagation direction of the waveguide and arranged to form a ridge protruding from a sidewall of the waveguide along part of the length of the waveguide;

wherein the at least one planar connection portion is disposed outside of the waveguide body and extends beyond an end of the waveguide body in the propagation direction of the waveguide; and wherein the waveguide has a rectangular cross-section, and is oriented relative to a substrate such that an elongated side of the waveguide is orthogonal to the substrate;

wherein the component is configured to generate a signal to be provided to the waveguide;

wherein the at least one planar connection portion of the foil is connected to the component; and wherein the component is a power amplifier or a low noise amplifier.

9. The waveguide arrangement of claim 8, wherein the component is arranged on the substrate.

10. The waveguide arrangement of claim 9, wherein the substrate is selected from the group consisting of a PCB, a silicon substrate, and a ceramic substrate.

11. The waveguide arrangement of claim 8:

wherein the at least one planar connection portion of the foil comprises two planar connection portions connected to the component;

wherein the component has a balanced output.

12. The waveguide arrangement of claim 8, wherein the at least one planar connection portion of the foil comprises two planar connection portions connected to two corresponding balanced differential lines.

13. The waveguide arrangement of claim 8, wherein the at least one planar connection portion of the foil is electrically connected to the component via soldering.

14. The waveguide arrangement of claim 8, wherein the at least one planar connection portion of the foil is electrically connected to the component via wire bonds.

15. The waveguide arrangement of claim 8, wherein the at least one planar connection portion of the foil is electrically connected to the component via glue.

16. A method for manufacturing a waveguide arrangement, the method comprising:

providing a waveguide, the waveguide comprising:

a tubular, electrically conductive waveguide body;

an electrically conductive foil, the foil comprising:

at least one planar matching portion arranged within the waveguide body and extending along a propagation direction of the waveguide body; and at least one planar connection portion arranged in a same plane as the at least one planar matching portion, the at least one planar connection portion disposed outside of the waveguide body for connecting the waveguide to a component;

wherein the at least one planar matching portion of the foil is tapered in the propagation direction of the waveguide and arranged to form a ridge protruding from a sidewall of the waveguide along part of the length of the waveguide;

wherein the at least one planar connection portion is disposed outside of the waveguide body and extends beyond an end of the waveguide body in the propagation direction of the waveguide; and wherein the waveguide has a rectangular cross-section;

providing a microwave component comprising at least one connection port for connecting to the waveguide, wherein the microwave component is a power amplifier or a low noise amplifier; and forming an electrical connection between the least one connection port of the component and the at least one planar connection portion of the foil.

17. The method of claim 16, wherein the electrical connection of the component to the foil is formed on the plane of the foil corresponding to a waveguide propagation plane.

18. The method of claim 16, wherein the electrical connection is formed by: soldering, wire bonding, and/or gluing.

* * * * *